US008622715B1

(12) United States Patent
Lott et al.

(10) Patent No.: US 8,622,715 B1
(45) Date of Patent: Jan. 7, 2014

(54) TWIN TURBINE ASYMMETRICAL NOZZLE AND JET PUMP INCORPORATING SUCH NOZZLE

(75) Inventors: William Gerald Lott, Houston, TX (US); William Jeffery Lott, Houston, TX (US)

(73) Assignee: Compatible Components Corporation, Houston, TX (US)

( * ) Notice: Subject to any disclaimer, the term of this patent is extended or adjusted under 35 U.S.C. 154(b) by 0 days.

(21) Appl. No.: 13/546,297

(22) Filed: Jul. 11, 2012

Related U.S. Application Data

(60) Provisional application No. 61/630,917, filed on Dec. 21, 2011.

(51) Int. Cl.
*F04F 5/00* (2006.01)
*F04F 5/44* (2006.01)
*B01F 15/00* (2006.01)

(52) U.S. Cl.
USPC ..... 417/198; 417/194; 366/163.2

(58) Field of Classification Search
USPC ..... 417/151, 194, 198; 366/163.2; 137/888, 137/896
See application file for complete search history.

(56) References Cited

U.S. PATENT DOCUMENTS

| | | | | | |
|---|---|---|---|---|---|
| 3,570,766 | A | * | 3/1971 | Johnson | 239/265.11 |
| 3,687,375 | A | * | 8/1972 | Griffiths | 239/557 |
| 4,505,646 | A | | 3/1985 | Long et al. | |
| 4,519,423 | A | * | 5/1985 | Ho et al. | 137/888 |
| 5,322,222 | A | | 6/1994 | Lott | |
| 5,522,419 | A | | 6/1996 | Sand | |
| 5,579,999 | A | * | 12/1996 | Seiner et al. | 239/265.11 |
| 5,664,733 | A | * | 9/1997 | Lott | 239/429 |
| 5,862,829 | A | | 1/1999 | Sand | |
| 5,863,128 | A | * | 1/1999 | Mazzei | 366/163.2 |
| 5,893,519 | A | | 4/1999 | Cavaretta et al. | |
| 5,927,338 | A | | 7/1999 | Boticki et al. | |
| 5,992,763 | A | * | 11/1999 | Smith et al. | 239/428.5 |
| 6,866,503 | B2 | * | 3/2005 | Ladharam | 431/10 |
| 7,487,795 | B2 | | 2/2009 | Sand | |
| 7,784,999 | B1 | | 8/2010 | Lott | |
| 8,020,726 | B1 | | 9/2011 | Gorenz et al. | |

* cited by examiner

*Primary Examiner* — Peter J Bertheaud
(74) *Attorney, Agent, or Firm* — Egbert Law Offices, PLLC

(57) ABSTRACT

A nozzle for use with a diffuser has a body with a fluid passageway extending through an interior thereof and having a fluid inlet and a fluid outlet. The body has an end surface formed at the fluid outlet. The body has an orifice formed through the end surface so as to communicate with the fluid passageway. The orifice has a first elliptical portion and a second elliptical portion. The elliptical portions are conjoined so as to communicate therebetween. The elliptical portions have major axes of equal length and minor axes of equal length. The nozzle is placed toward a mixing chamber of a jet pump.

10 Claims, 5 Drawing Sheets

TWIN TURBINE ASYMMETRICAL NOZZLE AND JET PUMP INCORPORATING SUCH NOZZLE

CROSS-REFERENCE TO RELATED APPLICATIONS

The present application claims priority from Unites States Provisional Patent Application Ser. No. 61/630,917, filed on Dec. 21, 2011, and entitled "Twin Turbine Mixing Nozzle".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to nozzles and jet pumps. More particularly, the present invention relates to nozzles that are used in association with a mixing chamber and a diffuser for the purpose of entraining and mixing solids with a liquid. More particularly, the present invention relates to nozzles having orifices of asymmetrical configuration.

2. Description of Related Art Including Information Disclosed Under 37 CFR 1.97 and 37 CFR 1.98.

Eductors and jet pumps are designed so as to utilize the Bernoulli principle of when pressure is high, velocity is low and inversely when velocity is high, pressure is low. The term "eductor" or jet pump describes a pump with no moving parts that converts pump pressure into a high-velocity stream (kinetic energy) in order to generate a low pressure. The resulting high-velocity stream produces a low pressure region that draws in and entrains a secondary powder or liquid through the suction inlet (induction port). At the intersection of the issuing motive liquid stream emanating from the nozzle orifice and the secondary additive entering the mixing chamber from the suction inlet, an exchange of momentum produces a mixed stream traveling at a velocity intermediate to the motive fluid and suction velocity. The downstream diffuser section then converts the velocity-pressure back into static pressure at the discharge of the jet pump. In addition to mixing a secondary powder or liquid with a motive liquid, these devices are used to convey, compress and mix gases and vapors.

Many eductor and jet pump designs incorporate tabs, skewed swirls and other downstream attachments in the diffuser section to attempt to generate more intense turbulence, thereby attempting to aid to enhance mixing a primary motive fluid with a secondary additive. These obstructions disturb the streamline flow pattern, causing "eddies" and waves that require considerable energy to support them. This energy is drawn from the primary flow-field (bulk fluid stream), thus reducing the energy level in the flow-field and ultimately reducing the diffuser efficiency. These structure formations may cause the boundary layer to prematurely detach from the pipe wall surface. Relatively larger particles will not follow the bulk liquid flow and will collide and collect on any obstacle in the downstream flow-field.

Generally, eductors and jet pumps are described with three components: (1) a nozzle; (2) an induction port (suction); and (3) a diffuser assembled in a housing. However, two of the most important and functional components of a jet pump are sometimes overlooked. In particular, these are the mixing chamber and the venturi throat section. The mixing chamber is located between the nozzle orifice discharge and the converging inlet into the venturi throat. This is the intersecting, comingling and interacting region between the motive fluid and the secondary additive that has been introduced through the induction port (suction). The first stage of mixing occurs in the mixing chamber and the final stage of mixing occurs in the venturi throat before entering the downstream diffuser section.

The motive nozzle should be designed to produce the highest possible velocity relative to the input energy. The downstream cross-sectional venturi throat should be designed to provide the strongest suction possible before the fluid enters the diffusion section. The diffuser should be designed to provide the greatest amount of energy recovery during conversion.

The diffuser section of the jet pump is a diverging duct that is shaped to gradually recover fluid static pressure from a fluid stream while reducing the downstream flow velocity. It is a means of converting kinetic energy into static pressure. During velocity deceleration and the increase in static pressure, it must be noted that if the diffuser angle of discharge is greater than ten degrees, fluid separation from the conduit wall may occur. In many technical articles, the diffuser discharge angle is recommended to be between seven and twelve degrees. Any higher angle than twelve degrees may cause separation. The diffuser is a pressure recovery tube that is shaped to gradually reduce the velocity and convert the energy into static pressure at the discharge with as little pressure loss as possible.

A key to an efficient and effective diffuser is one that lies in the ability to control the downstream boundary layer and delay detachment. When a flowing fluid stream comes in contact with a stationary surface, a portion of the free-flowing stream velocity is reduced. The free-flowing stream velocity reduction is caused by shear stress between the stationary conduit wall and the moving fluid stream. This frictional flow resistance is known as frictional or viscous drag. A thin layer of fluid adjacent to the conduit or pipe wall surface increases from zero to a mean velocity of the free-flowing stream. The viscous layer near the conduit wall is called the boundary layer. The boundary layer fluid gradually blends into the free-flowing stream.

Diffuser "stall" is the detachment or separation of flow from the diffuser internal surface walls during fluid deceleration causing the formation of "eddies" and a region of unsteady flow within the diffuser. The profile of flow exiting from the diffuser and the diffuser pressure recovery are intimately related to the possibility of diffuser stall. A downstream tendency to wall detachment that leads to diffuser stall can block the diffusion flow causing an unsteady and unstable exit flow that may result in a significant loss of pressure and, if the loss is great enough, a reversal of flow can occur. Boundary layer detachment will cause flow reversal. Wall detachment can be influenced by downstream obstruction, lack of energy input to pressurize the jet pump nozzle, excessive numbers of elbow in the downstream flow line cause frictional drag, and high viscosity fluids that can cause a thick boundary layer.

Diffuser performance is largely governed by the growth of the boundary layer and the degree to which the flow conforms to the diffuser internal surface walls. An efficient diffuser is one which converts the highest possible percentage of kinetic energy into pressure within a given restriction in diffuser length and expansion ratio (i.e. aspect ratio). The intensity of the flow-field velocity is determined by the motive feed pressure (Reynolds number), the total mass content of the admixture, the mixture density and downstream viscous drag.

FIG. 1 is an illustration of prior art eductor assembly. As can be seen, the eductor assembly 10 in FIG. 1 has an inlet nozzle section 12, a mixing chamber 14 and a diffuser section 16. The inlet nozzle section 12 has a tubular portion 18 that extends to a nozzle 20. The tubular portion 18 defines a primary inlet 22. The primary inlet 22 carries a fluid to the nozzle 20. The nozzle 20 has a wide diameter portion 24 opening to the primary inlet 22 and a narrow diameter opening 26 opening to the mixing chamber 14. The narrow diameter opening 26 is adjacent an end of the nozzle 20 opposite the wide diameter opening 24.

In FIG. 1, it can be seen that the mixing chamber 14 is connected to the inlet nozzle section 12 and is in fluid communication with the narrow diameter opening 26 of the nozzle 20. The mixing chamber 14 has an induction port 28 opening thereto and extending therefrom. In particular, it can be seen that the nozzle 20 has an outer surface 30 that extends greatly into the interior of the mixing chamber 14 and generally flows inwardly of the wall 32 of the induction port 28. As such, the outer surface 30 of the nozzle 20 provides a surface whereby any solids or solid particles that are introduced into the induction port 28 can accumulate thereon.

The diffuser section 16 has a secondary inlet 34 with a wide diameter end 36 adjacent the mixing chamber 14 and a narrow diameter end 38 formed inwardly thereof. The secondary inlet 34 is the Venturi of the eductor apparatus. A diffuser 40 is connected by a throat 42 to the secondary inlet 34. The throat 42 is of a generally constant diameter. The diffuser 40 has a narrow diameter end 44 at the throat 42 and a wide diameter end 46 at the end 48 of the diffuser 16.

In the past, various patent have issued relating to such jet pumps and nozzles associated therewith. For example, U.S. Pat. No. 4,505,646, issued on Mar. 19, 1985 to Long et al., describes an eductor pump and process for withdrawing a feed liquid from a container. The eductor pump includes a tubular body having a venturi element mounted inside and near the lower end of the tubular body. A conduit is used for feeding a drive liquid to the venturi element so that the drive liquid can flow through the venturi element and be directed upwardly in the tubular body. A feed liquid access opening in the closed lower end of the tubular body and a passageway from the access opening to the upstream side of the venturi element allows a feed liquid to be inspirated into an upward flow. An outlet is used to remove a mixed stream of feed liquid and drive liquid from the upper part of the tubular body.

U.S. Pat. No. 5,322,222, issued on Jun. 21, 1994 to the present inventor, shows a spiral jet fluid mixer for mixing fluids. This jet mixer has an elongated body having a first inlet nozzle for introduction of a primary fluid, a mixing chamber having a diverging wall and a converging wall, a plurality of angled helical passageways in the diverging wall for introduction of a secondary fluid into the mixing chamber in a spiralling turbulent, initially convergent, flow pattern. Removable inlet nozzles allow a plurality of inlet nozzle orifice diameters.

U.S. Pat. No. 5,522,419, issued on Jun. 4, 1996 to W. S. Sand, teaches an improved venturi eductor for proportionately dispensing of chemicals into flowing water. The venturi eductor has a large anti-siphoning air gap section. The air gap section includes an outer wall and an inner wall with a gap between the walls. Both walls include offset vents or windows that provide an indirect path from the center of the air gap to the exterior of the eductor.

U.S. Pat. No. 5,664,733 issued on Sep. 9, 1997 to the present inventor, shows an improved fluid mixing nozzle in which a first fluid flows therefrom to mix with a second fluid external the nozzle so as to induce vortex creation and chaotic turbulent flow. The nozzle has a body with a cavity extending therethrough from the inlet end to the outlet end. The cross-sectional area of the inlet orifice of the nozzle is greater than its outlet orifice cross-sectional area. The outlet orifice cross-section area shape has a substantially circular central portion and at least one protrusion extending from the perimeter of the central portion. The protrusions are smaller in cross-sectional area than the central portion, are equally spaced about the central portion perimeter, and have a length-to-width ratio from 1 to 2.

U.S. Pat. No. 5,862,829, issued on Jan. 26, 1999 to W. F. Sand, provides a three-piece air gap eductor having an air gap, discharge and venturi sections, a nozzle and a spray shield extending about the venturi section entry so as to constrain turbulence and reduce backsplash and spray exiting the air gap chamber. A water stream engaging the outer-driven venturi is smoothly divided into respective venturi and bypass streams. There is a frustoconical shield capturing turbulent water outside the venturi in a water sheet moving toward a discharge.

U.S. Pat. No. 5,893,519, issued on Apr. 13, 1999 to Cavaretta et al., describes a self-educting, high expansion, multi-agent nozzle. This nozzle includes a body having an eductor section and a barrel section. The eductor section forms a vacuum chamber and first and second chemical ports adapted for connecting to a first and second chemical source. The barrel section forms a pathway between an inlet from the eductor section to an open discharge end. A head forms a tapered conduit between an open motive fluid end adapted for connecting to a motive fluid source and an open exit end. The head is connected to an open head end of the eductor section is in a manner such that the exit end is disposed within the vacuum chamber. A barrel sleeve is movably connected to an exterior surface of the barrel section. The diffuser is mounted within the pathway of the barrel section.

U.S. Pat. No. 5,927,338, issued on Jul. 27, 1999 to Boticki et al., teaches a mixing eductor of a type wherein the primary liquid flows in a downstream direction. A venturi tube is in the eductor and has an annular sharp edge in the main stream so as to divide the stream into a primary stream and a secondary stream around the primary stream. The eductor has an air gap and a flow guide downstream thereof. The flow guide is annular surface around the venturi tube.

U.S. Pat. No. 7,487,795, issued on Feb. 10, 2009 to W. F. Sand, describes an improved chemical dispenser having a plurality of eductors for drawing a chemical into a diluent to produce an effluent. Each eductor selectively discharges via a baffle tube into a single common discharge tube. The effluent flow parameters are insufficient to cause effluent from a selected eductor to flow into a chemical source coupled to a non-selected eductor.

U.S. Pat. No. 7,784,999, issued on Aug. 31, 2010 to the present inventor, shows an eductor apparatus that has an inlet nozzle section with a primary inlet and a nozzle, a mixing chamber connected to the inlet nozzle section and in fluid communication with a narrow diameter opening of the nozzle, and a diffuser section connected to the mixing chamber opposite the inlet nozzle section. The diffuser section has throat formed therein. The throat has a plurality of lobes formed thereon. The plurality of lobes extend longitudinally along the throat. The lobes are generally equally circumferentially spaced from each other around the throat. The narrow diameter opening of the nozzle has another plurality of lobes formed therearound and extending in longitudinally alignment with the plurality of lobes of the throat.

U.S. Pat. No. 8,020,726, issued on Sep. 20, 2011 to Gorenz et al., provides a powder dispersion system which includes an air eductor and a powder-dispensing syringe. The air eductor and a powder-dispensing syringe are inserted into a suction connection of the air eductor.

It is an object of the present invention to provide a mixing nozzle that can be used in a versatile manner for the mixing of liquids or the mixing of the liquids with solids or solid particles.

It is another object of the present invention to provide a mixing nozzle that can be utilized as a stand-alone mixer in a closed conduit or in an open tank.

It is another object of the present invention to provide a mixing nozzle that generates downstream axial switching of the liquid.

It is still a further object of the present invention to provide a jet pump that energizes the downstream boundary layer to prevent "stall".

It is still a further object of the present invention to provide a jet pump assembly that has an efficient pressure recovery.

It is another object of the present invention to provide a jet pump assembly that can generate a near-perfect vacuum.

It is another object of the present invention to provide a jet pump assembly that can be utilized as a submerged jet pump.

It is another object of the present invention to provide a jet pump assembly that can generate overlapping vortices.

It is still another object of the present invention to provide a jet pump assembly that can mix and deliver a dispersed product.

It is another object of the present invention to provide a jet pump assembly that can deliver longer distances than conventional jet pumps.

It is a further object of the present invention to provide a jet pump assembly that can produce a uniform mixture.

It is a further object of the present invention to provide a jet pump assembly which avoids the production of "fish eyes" in the produced product.

These and other objects and advantages of the present invention will become apparent from a reading of the attached specification and appended claims.

BRIEF SUMMARY OF THE INVENTION

The present invention is a nozzle that comprises a body with a fluid passageway extending through an interior thereof. The fluid passageway has a fluid inlet and a fluid outlet. The body has an end surface formed at the fluid outlet. The body has an orifice formed through the end surface so as to communicate with the fluid passageway. The orifice has a first elliptical portion and a second elliptical portion. Each of the first and second elliptical portions having a major axis and a minor axis.

In the preferred embodiment of the present invention, the first elliptical portion and the second elliptical portion are conjoined so as to communicate therebetween. This conjunction of the first and second elliptical portions has a length dimension extending in parallel relation to the major axes of the first and second elliptical portions. The length dimension of the conjunction is less than a length dimension of either of the major axes of the first and second elliptical portions. The major axis of the first elliptical portion is in parallel relation to the major axis of the second elliptical portion. The minor axis of the first elliptical portion is aligned with the minor axis of the second elliptical portion. The major axis of the first elliptical portion has a length dimension approximately twice a length dimension of the minor axis of the first elliptical portion. The major axis of the second elliptical portion has a length dimension of approximately twice a length dimension of the minor axis of the second elliptical portion. The major axis of the first elliptical portion has a length that is equal to a length of the major axis of the second elliptical portion. The minor axis of the first elliptical portion has a length equal to a length of the minor axis of the second elliptical portion.

The fluid passageway has a first section extending inwardly from the fluid inlet and a second section converging toward the orifice. The orifice converges from an end of the second section toward the end surface. The orifice has a length that is less than a length of the second section. The first section has a generally constant diameter extending toward the second section. The second section converges at approximately 30° toward the orifice. The orifice converges at approximately 8° toward the end surface.

The present invention is also a jet pump that comprises a mixing chamber having a first inlet and a second inlet and an outlet, a nozzle positioned at the fluid inlet, and a diffuser positioned at the outlet of the mixing chamber. The diffuser has an outlet at the end opposite the mixing chamber. The nozzle has a body having a fluid passageway extending through an interior thereof. The fluid passageway has a fluid inlet and a fluid outlet. The body has an end surface formed at the fluid outlet. The body has an orifice formed through the end surface so as to communicate with the fluid passageway. The orifice has a first elliptical portion and a second elliptical portion. Each of first and second elliptical portions has a major axis and a minor axis.

The nozzle has a longitudinal axis aligned with a longitudinal axis of the diffuser. The first inlet of the mixing chamber is in transverse relationship to the second inlet surface of the mixing chamber. The outlet of the mixing chamber is axially aligned with the first inlet.

The diffuser has a secondary inlet communicating with the outlet of the mixing chamber, a throat formed at one end of the secondary inlet, and a Venturi extending from the throat to the outlet of the diffuser. The second inlet converges from the outlet of the mixing chamber toward the throat. The Venturi diverges from the throat to the outlet of the diffuser. The Venturi has a conical shape.

The nozzle of the present invention allows a first pressurized fluid to evolve into a pair of secondary jet streams. The asymmetrical converging nozzle of the present invention generates twin geometrically-opposing downstream vortices. The fluid passing through the nozzle can be pressurized using a positive displacement or progressive-cavity pump. Any functional centrifugal pumps that can generate a constant head pressure to produce an issuing velocity at 67 feet per second as the minium velocity is the preferred form of pump.

The low aspect-ratio between a major axis and a minor axis in each elliptical portion generates strong vortical structures that create an interaction between the issuing flow stream and a secondary static liquid producing turbulent mixing. The preferred operating issuing velocity range is 77 feet per second to 95 feet per second. The 77 feet per second will translate into 40 p.s.i. or 92 feet of head and 95 feet per second translates into 60 p.s.i. or 139 feet of head.

When the converging nozzle is pressurized, it converts high-pressure, low-velocity flow into high-velocity, low-pressure flow. Since the aspect ratio is 2:1 between the major axis and the minor axis of each elliptical portion, axial shifting develops downstream. Axis switching is a phenomenon in which the cross-section of an asymmetrical nozzle evolves in such manner that axis switching occurs at a certain distance downstream of the nozzle. In other words, the major and minor axes are interchanged.

In the present invention, the boundary layer surfaces are short, smooth and uniform in design. At each point within the short converging surfaces in the nozzle, the gradient and static pressure favors the flow and, as a result, the fluid continually accelerates toward the nozzle exit. The short converging surfaces of the nozzle serve to reduce boundary layer friction drag.

The primary application of the present invention is for non-compressible fluids. The nozzle configuration would change for compressible fluids.

The foregoing section is intended to describe, in generality, the preferred embodiment of the present invention. It is understood that variations in the present invention can be made within the scope of the present invention. As such, this section should not be construed, in any way, as limiting of the scope of the present invention. The present invention should be only be limited by the following claims and their legal equivalents.

DETAILED DESCRIPTION OF THE INVENTION

Figure 1:
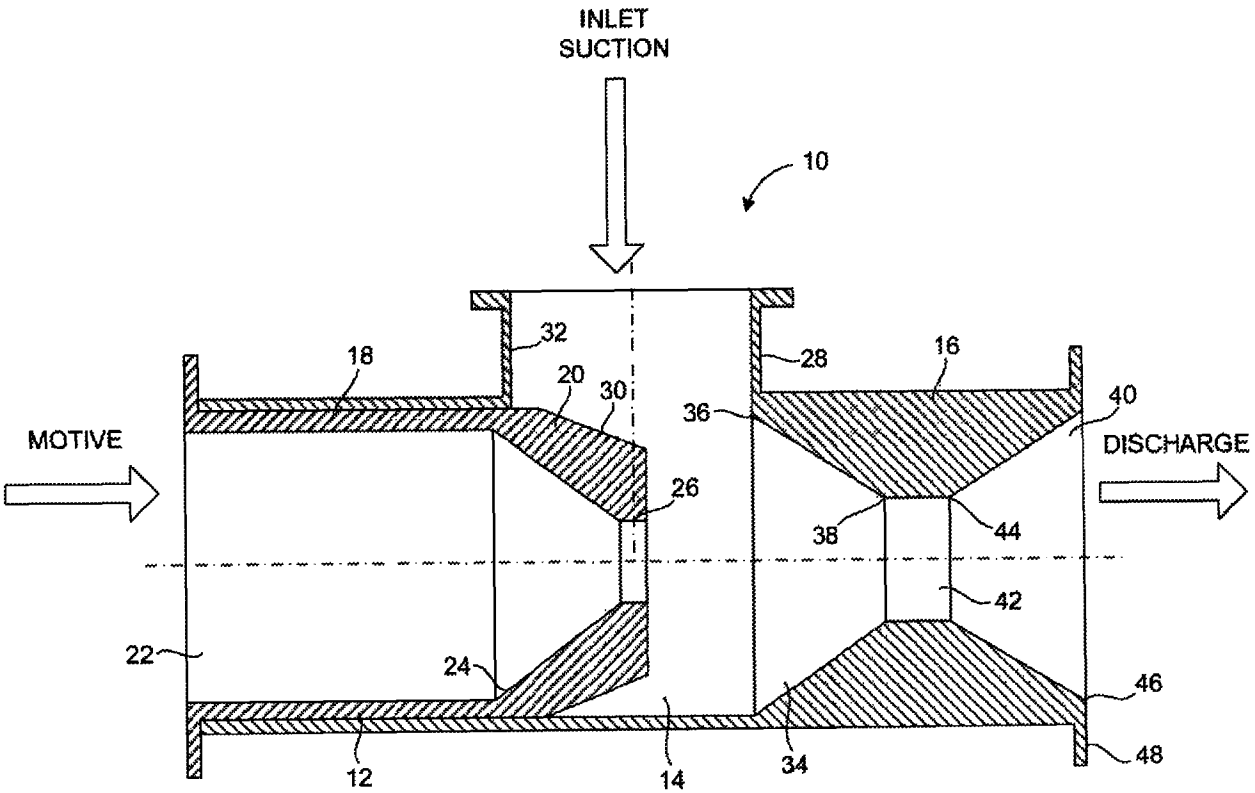
FIG. 1 Prior Art
FIG. 1 is a cross-sectional of a prior art jet pump.

Referring to FIG. 1, there is shown the nozzle 50 in accordance with the preferred embodiment of the present invention. The nozzle 50 includes a body 52 having a generally cylindrical configuration. The body 52 has an end surface 54. Orifice 56 is formed through the end surface 54 so as to open to a fluid passageway located within the interior of the body 52. A flange 58 is formed at the end of the body 52 opposite the end surface 54. Flange 58 allows the nozzle 50 to be incorporated into a jet pump system.

Figure 2:
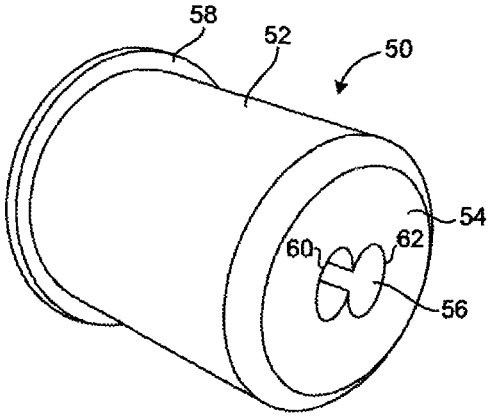
FIG. 2 is an upper perspective view of the nozzle of the present invention.

In FIG. 2, it can be seen that the nozzle 56 has a first elliptical portion 60 and a second elliptical portion 62. Elliptical portions 60 and 62 converge together so as to communicate therebetween. Each of the elliptical portions 60 and 62 has a major axis and a minor axis. The relationship between the major axes and the minor axes will be described hereinafter in association with FIG. 6.

Figure 3:
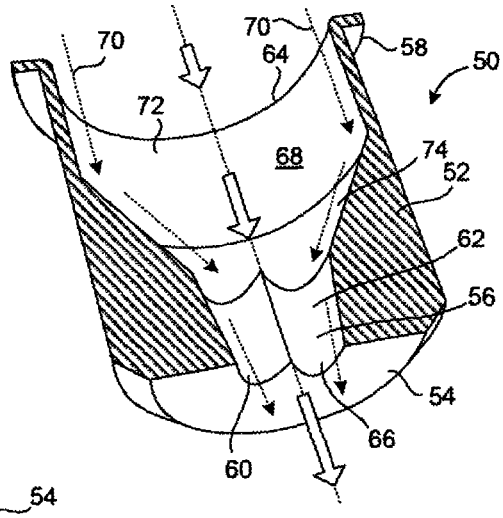
FIG. 3 is isometric cross-sectional view of the nozzle of the present invention.

FIG. 3 is a cross-sectional view of the nozzle 50. In particular, the body 54 has a fluid inlet 64 and a fluid outlet 66. The end surface 54 is formed at the fluid outlet 66. The flange 58 is formed at the fluid inlet. Fluid passageway 68 is formed through the interior of the body 52. The orifices 60 and 62 are formed through the end surface 54 of the body 52 so as to communicate with the fluid passageway 68.

In FIG. 3, arrows 70 show the flow of a fluid through the fluid passageway 68. As can be seen, the fluid will pass along a first section 72, to a second section 74, and then into the first elliptical portion 60 and the second elliptical portion 62 of the orifice 56. The first section 62 has a generally constant diameter as it extends to the second section 74. The second section 74 converges inwardly from the first section 68 toward the first and second elliptical portions of the nozzle 50. The orifice 56 will also converge at an angle from the end of the second section 74 opposite the first section 72 toward the end surface 54 of the body 52.

Figure 4:
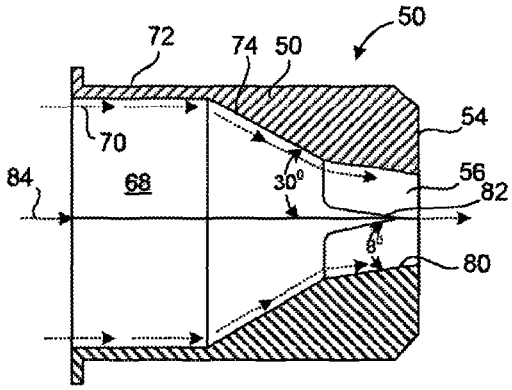
FIG. 4 is a cross-sectional view of the nozzle of the present invention.

FIG. 4 is another cross-sectional view of the nozzle 50 of the present invention. As can be seen, the body 52 has the first section 72, the second section 74 and the nozzle 56. The nozzle 56 opens, at one end, to the end surface 54 of body 52. The wall 80 surrounding the nozzle 56 converges inwardly at approximately 8° from the end of the second section 74 to the fluid outlet at the end surface 54. The second section 74 will converge from the first section 72 to the end of the nozzle 56 at approximately 30° angle. It can be seen in FIG. 4 that the first section 72 has a generally constant diameter.

Fins 82 are generally formed at the conjunction of the first elliptical portion 60 and the second elliptical portion 62 of the orifice 56. These fins 82 serve to urge the fluid passing through the fluid passageway 68 of the nozzle 50 outwardly. The converging angle of the orifice 56 serves to bring the fluid back so as to flow directly outwardly. The configuration of the nozzle 56 corral the fluid so as to pass the fluid outwardly toward the diffusor section. The convergent second section 74 converts the pump pressure into a high-velocity stream. It can be seen that the nozzle 56 has a length dimension that is less than the length dimension of the second section 74 and/or the first section 72. Arrows 70 show the flow of the fluid along the surfaces associated with the first section 72, the second section 74 and the orifice 56. In particular, arrows 70 show the flow of the fluid as part of the boundary layer adjacent to the surfaces. Arrow 84 shows the direct path of the fluid through the interior passageway 68. It can be seen that the boundary layer surfaces are short, smooth and uniform in design. At each point within the short converging surfaces in the orifice 56, the gradient and static pressure favors the flow and, as a result, the fluid continuously accelerates toward the exit of the nozzle 50. The short converging surface of the orifice 56 reduces the boundary layer frictional drag. If the converging surfaces of the orifice 56 were long, then this would detract from the nozzle performance.

Figure 5:
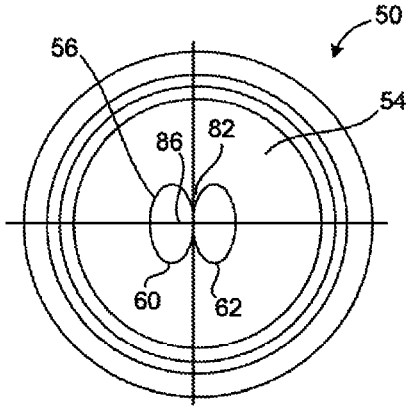
FIG. 5 is an end view of the nozzle of the present invention.

FIG. 5 is an end view of the nozzle 50 showing, in particular, the end surface 54 and the configuration of the orifice 56. The orifice 56 has a first elliptical portion 60 and a second elliptical portion 62. The elliptical portions 60 and 62 converge in a center 86 so as to communicate therebetween. This conjunction defines the fins 82 positioned between the elliptical portions 60 and 62.

Figure 6:
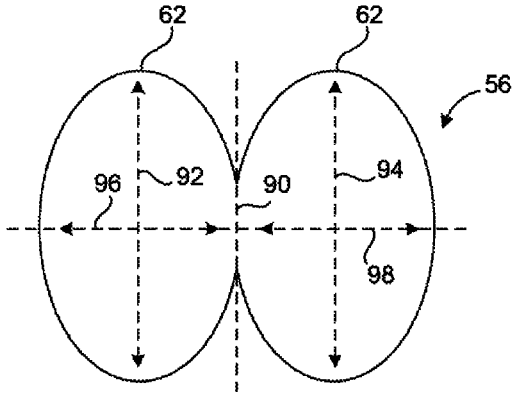
FIG. 6 is a diagrammatic view of the asymmetrical orifice as used in the nozzle of the present invention.

FIG. 6 is a detailed view of the configuration of the first elliptical portion 60 and the second elliptical portion 62 of the orifice 56. The conjunction of the first elliptical portion 60 and the second elliptical portion 62 has a length dimension 90 that extends in parallel relationship to the major axes 92 and 94 of the first elliptical portion 60 and the second elliptical portion 62, respectively. The length dimension of the conjunction 90 is less than the length dimension of either of the major axes 92 and 94 of the first elliptical portion 60 and the second elliptical portion 62, respectively. The major axis 92 of the first elliptical portion 60 is shown in parallel relationship to the major axis 94 of the second elliptical portion 62. The minor axis 96 of the first elliptical portion 60 is aligned with the minor axis 98 of the second elliptical portion 62. The major axis 92 of the first elliptical portion 60 has a length dimension that is approximately twice a length dimension of the minor axis 96 of the first elliptical portion 60. The major axis 94 of the second elliptical portion 62 has a length dimension that is twice the length dimension of the minor axis 98. The major axis 92 has a length that is equal to the length of the major axis 94. The length dimension of the minor axis 96 of the first elliptical portion 60 is equal to the length dimension of the minor axis 98 of the second elliptical portion 62. This particular arrangement of the length dimensions of the major and minor axes creates the unique flow pattern as shown in FIG. 7.

Figure 7:
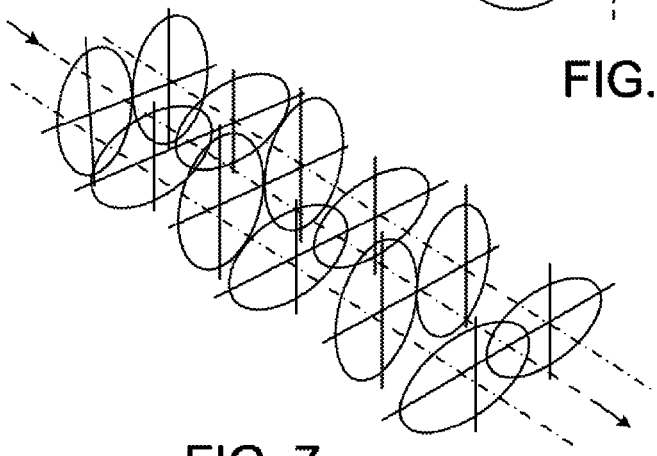
FIG. 7 is an illustration showing the axis switching phenomenon that occurs as the result of passing pressurized fluid through the orifice of the nozzle of the present invention.

FIG. 7 shows the flow pattern of the fluid as it exits the nozzle 56 at end surface 54. The asymmetrical converging nozzle 56 generates twin geometrically-opposing downstream vortices. The low aspect-ratio between the major axis and the minor axis in each of the first elliptical portion 60 and the second elliptical portion 62 generates strong vortical structures that create an interaction between the issuing flow stream and a secondary static liquid-producing turbulent mixing. When the nozzle 50 is pressurized, it converts high-pressure, low-velocity flow into high-velocity, low-pressure flow. Since the aspect ratio is 2:1 between the major axis and the minor axis, axis switching develops downstream, as can be seen in FIG. 7. Axis switching is a phenomenon that occurs because of the cross-section of the asymmetrical nozzle 56. The axis switching evolves in such manner that axis switching occurs at a certain distance downstream of the nozzle. As such, the major and minor axes of the fluid flow are interchanged. This arrangement enhances entrainment and causes intense mixing in comparison to planar and conventional symmetrical nozzles or circular nozzles.

The downstream swirling vortices generated by the jet pump nozzle configuration will improve the velocity distribution so as to yield a more uniform exit velocity profile. The expanding uniform velocity distribution increases the velocity along the pipe boundary layer. The increased velocity near the wall surface reduces the frictional drag, thereby increasing the suction strength and the pressure recovery of the diffuser.

Figure 8:
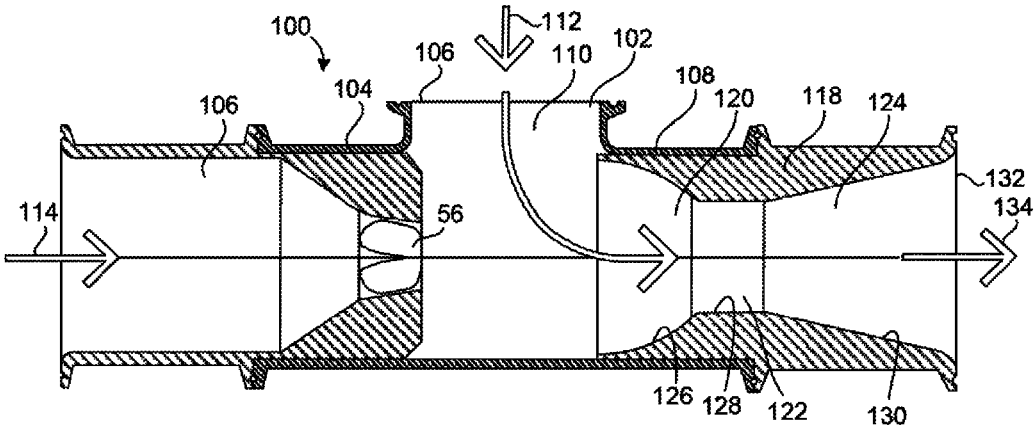
FIG. 8 is a cross-sectional view showing the jet pump of the present invention.

FIG. 8 shows the jet pump 100 in accordance with the teachings of the present invention. The jet pump 100 includes a mixing chamber 102 having a first inlet 104, a second inlet 106 and an outlet 108. The interior volume 110 allows the mixing of fluid and/or solids or solid particles 112 that are introduced into the second inlet 106 to mix with a fluid 114 that passes the nozzle 116 through the first inlet 104. The nozzle 116 has a configuration identical to the configuration of the nozzle 50 as described hereinabove. Ultimately, the orifice 56 will open into the interior volume 110 of the mixing chamber 102. A diffuser 118 is connected to the outlet 108 of the mixing chamber 102. The diffuser 118 includes a secondary inlet 120, a throat 122 and a Venturi 124.

The flow of the fluid through the orifice 56 of the nozzle 116 will pass into the interior volume 110 of the mixing chamber 102 so as to begin mix with the solids or liquid 112. This mixture will flow into the secondary inlet 120. Secondary inlet 120 has a converging inner wall 126 which extends from the interior volume 110 of the mixing chamber 102 toward the throat 122. The throat 122 has a generally constant diameter and extends from the secondary inlet 120 to the Venturi 124. The wall 130 of the Venturi 124 will diverge outwardly of approximately 15° angle from the throat 122 to the fluid outlet 132. The Venturi 124 will have a conical shape. As such, the mixture 134 can flow outwardly of the fluid outlet 132.

The throat 122 has a cross-section that is 15% to 30% greater in area than the area of a cross-section of the nozzle 50. The preferred size is 20% greater. If the fluid viscosity is relatively high or if the viscosity of the fluid is above a specific gravity of 1.8 or larger ratio is required in order for the throat 122 to accommodate the more viscous or more dense non-compressive fluid.

The excitement of the exit boundary eliminates the need to obey the 15° angle rule for conical and two-dimensional diffusers. The divergent angle can be as high as 30° without wall detachment or separation. This secures the overall length of the eductor and can be used in a restricted space.

Figure 9:
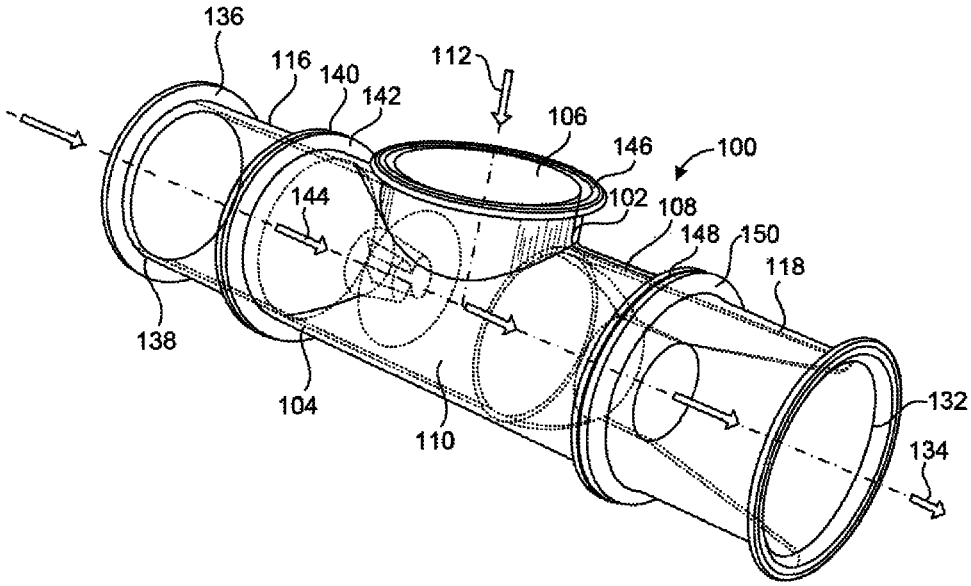
FIG. 9 is a perspective view of the jet pump of the present invention.

FIG. 9 shows the jet pump 100 as configured together. In particular, the nozzle 116 has a flange 136 extending outwardly at the fluid inlet 138. Another flange 140 can be joined to the flange 142 of the mixing chamber 102. As such, the fluid passageway 144 of the nozzle 116 will be axially aligned with the first inlet 104 of the mixing chamber 102. The second inlet 106 of the mixing chamber 102 also has a flange 146 formed thereon. Flange 146 allows the second inlet 106 to be joined to another pipe so that the solids or liquid 112 can be delivered thereinto and into the interior volume 110 of the mixing chamber 102. The outlet 108 has a flange 148 formed at an end thereof. Flange 148 can be joined to the flange 150 of the diffuser 188. As such, the diffuser 188 can provide its fluid outlet 132 so that the mixed fluid/solids or fluid/fluid 134 to pass outwardly therefrom.

Figure 10:
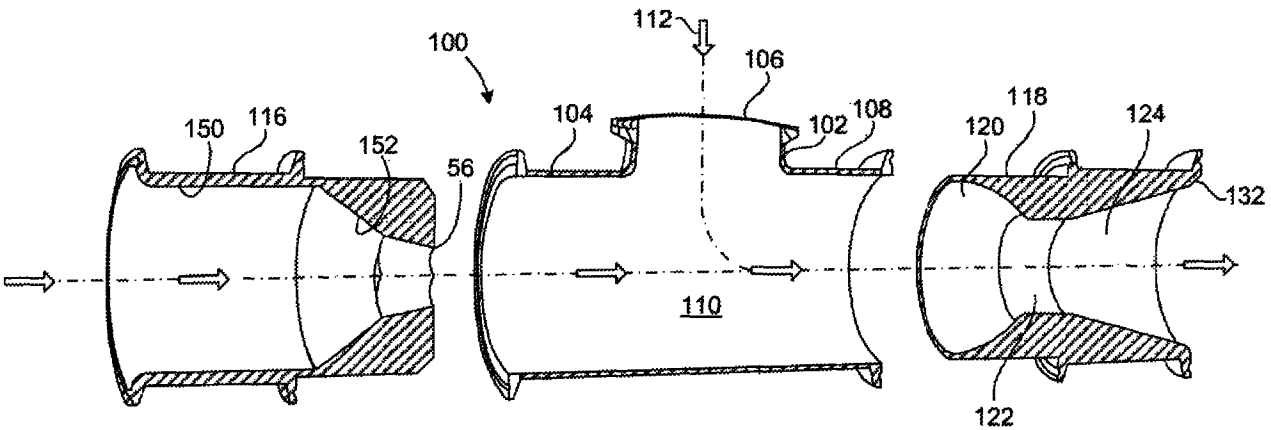
FIG. 10 is an exploded cross-sectional view of the jet pump of the present invention.

FIG. 10 is an exploded view showing the arrangement of the jet pump 100 of the present invention. Initially, the nozzle 116 includes a generally constant diameter first section 150 that leads to a converging second section 152. Converging second section 152 then opens to the orifice 56. The mixing chamber 102 shows that its first inlet 104 receives the end of the nozzle 116 therein. As such, the orifice 56 can be generally placed adjacent to the interior volume 110 of the mixing chamber 102. The second inlet 106 extends in generally transverse relationship to the first inlet 104 so that the liquid or solids 112 can pass thereinto and into the interior volume 110 of the mixing chamber 102.

The diffuser 118 is received within the outlet 108 of the mixing chamber 102. As a result, the secondary inlet 120 is placed in close proximity to the interior volume 110 of the mixing chamber 102. The throat 122 receives the liquid/liquid mixture or solids/liquid mixture from the secondary inlet 120. The Venturi 124 then diverges outwardly toward the outlet 32. Suitable pumps can be provided associated with the jet pump 110 so that pressurized fluid can be delivered thereto. Typically, a positive displacement or progressive cavity pump can be utilized in association with the jet pump 100. Additionally, any function centrifugal pump can be used provided that the centrifugal pump can generate a constant head pressure so as to produce an issuing velocity of at least 67 feet per second as the minium velocity. The preferred operating issuing velocity range of 77 feet per second to 95 feet per second. The 77 feet per second will translate into 40 p.s.i. or 92 feet of head. The 95 feet per second will translate into 60 p.s.i. or 139 feet of head.

The jet pump 100 of the present invention is very versatile. It can be used for mixing liquids and solids. The jet pump 100 can be utilized as a stand-alone mixture in a closed conduit or in an open tank. The mixing nozzle as used in the jet pump 100 of the present invention energizes the downstream boundary layer so as to prevent "stall". The jet pump 100 has very efficient pressure recovery. In particular, it is believed that pressure recovery in the order of seventy percent can be provided with the jet pump 100 of the present invention. This serves to speed up the flow of the solids and provides for longer delivery distances. Additionally, this serves to speed up the flow against the walls of the jet pump 100 so as to reduce the width of boundary layer. The nozzle of the present invention will speed up the boundary area and reduce friction drag. The jet pump 100 generates a near-perfect vacuum. Ultimately, a dispersed product can be mixed and delivered through the use of jet pump 100 of the present invention. Additionally, this dispersed product can be mixed and delivered through the use of the jet pump 100 of the present invention. Additionally, this dispersed product can be of a uniform mixture. The jet pump 100 greatly improves the efficiency of the mixing process compared to prior art eductors or jet pumps.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

What is claimed is:

1. A nozzle comprising:

a body having a fluid passageway extending through an interior thereof, said fluid passageway having a fluid inlet and a fluid outlet, said body having an end surface formed at said fluid outlet, said body having an orifice formed through said end surface, said orifice having a first elliptical portion and a second elliptical portion, each of said first and second elliptical portions having a major axis and a minor axis, said first elliptical portion and said second elliptical portion being conjoined so as to communicate therebetween, the conjunction of said first and second elliptical portions having a length dimension extending in parallel relation to the major axes of said first and second elliptical portions, said length dimension of the conjunction being less than a length dimension of either of the major axis of said first and second elliptical portions.

2. The nozzle of claim 1, said minor axis of said first elliptical portion being aligned with said minor axis of said second elliptical portion.

3. A jet pump comprising:

a mixing chamber having a first inlet and a second inlet and an outlet;

a nozzle positioned at said first inlet, said nozzle having a body having a fluid passageway extending through an interior thereof, said fluid passageway having a fluid inlet and a fluid outlet, said body having an end surface formed at said fluid outlet adjacent said mixing chamber, said body having an orifice formed through said end surface so as to communicate with said fluid passageway and so as to open to said first inlet of said mixing chamber, said orifice having a first elliptical portion and a second elliptical portion, each of first and second elliptical portions having a major axis and a minor axis, said first elliptical portion and said second elliptical portion being conjoined so as to communicate therebetween, the conjunction of said first and second elliptical portions having a length dimension extending in parallel relation to the major axes of said first and second elliptical portions, said length dimension of the conjunction being less than a length dimension of either of the major axes of said first and second elliptical portions; and a diffuser positioned at said outlet of said mixing chamber, said diffuser having an outlet at an end opposite said mixing chamber.

4. The jet pump of claim 3, said minor axis of said first elliptical portion being aligned with said minor axis of said second elliptical portion.

5. The jet pump of claim 3, said major axis of said first elliptical portion having a length dimension approximately twice a length dimension of said minor axis of said first elliptical portion, said major axis of said second elliptical portion having a length dimension of approximately twice a length dimension of said minor axis of said second elliptical portion.

6. The jet pump of claim 3, said major axis of said first elliptical portion having a length dimension equal to a length dimension of said major axis of said second elliptical portion, said minor axis of said first elliptical portion having a length equal to a length of said minor axis of said second elliptical portion.

7. The jet pump of claim 3, said fluid passageway having a first section extend inwardly from said fluid inlet and a second section converging toward said orifice, said orifice converging from an end of said second section toward said end surface.

8. The jet pump of claim 3, said nozzle having a longitudinal axis aligned with a longitudinal axis of said diffuser.

9. The jet pump of claim 3, said first inlet of said mixing chamber being in transverse relationship to said second inlet of said mixing chamber, said outlet of said mixing chamber being axially aligned with said first inlet.

10. The jet pump of claim 3, said diffuser comprising:

a secondary inlet communicating with said outlet of said mixing chamber;

a throat formed at an end of said secondary inlet, said secondary inlet converging from said outlet to said mixing chamber toward said throat; and a Venturi extending from said throat to said outlet of said diffuser, said Venturi diverging from said throat to said outlet of said diffuser.

* * * * *